United States Patent [19]

Yoshida et al.

[11] 4,285,831

[45] Aug. 25, 1981

[54] PROCESS FOR PRODUCTION OF ACTIVATED CARBON FIBERS

[75] Inventors: Masatoshi Yoshida, Mishima; Minoru Hirai, Shizuoka, both of Japan

[73] Assignee: Toho Beslon Co., Ltd., Tokyo, Japan

[21] Appl. No.: 32,193

[22] Filed: Apr. 23, 1979

Related U.S. Application Data

[63] Continuation-in-part of Ser. No. 785,888, Apr. 8, 1977.

[30] Foreign Application Priority Data

Oct. 5, 1976 [JP] Japan ..... 51/118989

[51] Int. Cl.[3] ..... B01J 37/00; D01F 9/12; D02G 3/00

[52] U.S. Cl. ..... 252/423; 252/421; 252/422; 252/425; 264/29.2; 423/447.2; 423/447.4; 423/447.6; 428/367

[58] Field of Search ..... 423/447.1, 447.2, 447.4, 423/447.6, 447.7; 428/367, 224, 408; 264/29.2; 252/421, 438, 422, 423, 425

[56] References Cited

U.S. PATENT DOCUMENTS

| | | | |
|---|---|---|---|
| 3,412,062 | 11/1968 | Johnson | 260/37 |
| 3,454,362 | 7/1969 | Spry | 264/29.2 |
| 3,556,729 | 1/1971 | Holsten et al. | 8/115.5 |
| 3,567,380 | 3/1971 | Townsend | 423/447.6 |
| 3,607,059 | 9/1971 | Too et al. | 8/115.5 |
| 3,615,212 | 10/1971 | Whitney et al. | 8/115.5 |
| 3,632,798 | 1/1972 | Morita et al. | 264/29.2 |
| 3,666,417 | 5/1972 | Araki et al. | 8/115.5 |
| 3,671,192 | 6/1972 | Ezekiel | 8/115.5 |
| 3,723,150 | 3/1973 | Druin et al. | 106/307 |
| 3,745,104 | 7/1973 | Hou | 423/447.6 X |
| 3,813,219 | 5/1974 | DiEdwardo et al. | 8/115.5 |
| 3,814,577 | 6/1974 | Menikheim | 8/115.5 |
| 3,820,951 | 6/1974 | DiEdwardo et al. | 423/447.6 X |
| 3,945,093 | 3/1976 | Larsen et al. | 8/115.5 |
| 3,954,947 | 5/1976 | Didcheako et al. | 8/115.5 |
| 3,961,888 | 6/1976 | Riggs | 423/447.6 X |
| 3,972,984 | 8/1976 | Iizuka | 423/447.6 |
| 4,009,248 | 2/1977 | Kishimoto et al. | 423/447.6 X |
| 4,031,188 | 6/1977 | Kohler | 8/115.5 |
| 4,069,297 | 1/1978 | Saito et al. | 423/447.6 |
| 4,118,341 | 10/1978 | Ishibashi et al. | 252/348 |

FOREIGN PATENT DOCUMENTS

| | | |
|---|---|---|
| 38-12376 | 7/1960 | Japan . |
| 49-116332 | 11/1974 | Japan . |

OTHER PUBLICATIONS

Lin et al., "The Preparation and Properties of Activated Carbon Fibers Derived from Phenolic Precursor" Applied Polymer Symposium No. 21, 143–152 (1973).

*Primary Examiner*—Lorraine T. Kendell
*Attorney, Agent, or Firm*—Sughrue, Mion, Zinn, Macpeak and Seas

[57] ABSTRACT

A process for producing activated carbon fibers of high adsorption capacity which comprises oxidizing an acrylonitrile based fiber, wherein the acrylonitrile based fiber is a homopolymer of acrylonitrile, a copolymer containing about 60% by weight or more of acrylonitrile, or a mixture of polymers such that about 60% by weight or more of acrylonitrile is present in the mixture, in an oxidizing atmosphere at a temperature of about 200° C. to about 300° C. while applying a tension to the fiber until the amount of bonded oxygen reaches about 65% to about 95% of the saturated amount of bonded oxygen of the fiber, wherein the tension applied is such that the shrinkage of the fiber during oxidation reaches about 70% to about 90% of the degree of free shrinkage at the same temperature, and then activating the fiber.

19 Claims, 4 Drawing Figures

PROCESS FOR PRODUCTION OF ACTIVATED CARBON FIBERS

CROSS REFERENCE TO RELATED APPLICATION

This application is a continuation-in-part application of copending application, Ser. No. 785,888, filed Apr. 8, 1977.

BACKGROUND OF THE INVENTION

1. Field of the Invention

The present invention relates to a process for production of activated carbon fibers from an acrylonitrile based fiber by application of oxidation and activation processings.

2. Description of the Prior Art

Activated carbon is very useful as an adsorbent. Recently, the demand for activating carbon has been increasing particularly in the field of prevention of environmental pollution.

Hitherto, activated carbon has been produced from charcoal, animal charcoal, etc., and it is now possible to produce activated carbon from synthetic resins such as polyvinyl chloride, polyvinylidene chloride, and the like. In addition, a method of producing activated carbon fibers by subjecting the fiber of a phenol resin to carbonization and activation processings is known and described in *Applied Polymer Symposium,* No. 21, page 143 (1973), for example.

While the use of activated carbon as a fiber has the advantage in that it can be used more functionally than the conventional powdery or granular activated carbon, the above-described method has not been put into practice since the starting materials are quite expensive.

Recently, a method for producing an activated carbon fiber from a polyacrylonitrile fiber has been developed. Japanese patent application (OPI) No. 116332/74 discloses that an activated carbon fiber can be obtained by subjecting a polyacrylonitrile fiber to oxidation in an oxidizing atmosphere at 200°–300° C. without applying tension, and then activating the thus obtained oxidized fiber in an activating atmosphere containing streams and/or $CO_2$ gas at 700°–1,000° C. without applying tension. Although, by this method an activated carbon fiber having excellent adsorption capacity can be obtained, the mechanical properties of the fiber are very poor. It is difficult to maintain the shape of the activated carbon fiber on handling in actual use.

As a result of extensive investigations directed to overcoming the lack of good mechanical properties it has been found that by adjusting the amount of bonded oxygen in the oxidized fiber to a certain amount on oxidation, and by controlling the shrinkage of the fiber during the oxidation to a limited value an activated carbon fiber having not only an excellent adsorption capacity but also excellent mechanical properties can be obtained.

SUMMARY OF THE INVENTION

An object of the present invention is to provide a process for producing an activated carbon fiber from the fiber of a relatively low-priced synthetic resin by simple operations.

Another object of the present invention is to provide a process for producing an activated carbon fiber having excellent adsorption capacities and sufficient mechanical strength.

Still another object of the present invention is to provide an activated carbon fiber having excellent adsorption capacity and sufficient mechanical strength.

These objects are attained by subjecting an acrylonitrile based fiber, which is a homopolymer of acrylonitrile, a copolymer containing about 60% by weight or more of acrylonitrile, or a mixture of polymers such that about 60% by weight or more of acrylonitrile is present in the mixture, to oxidation in an oxidizing atmosphere at a temperature of about 200° C. to about 300° C. while applying a tension to the fiber until the amount of bonded oxygen reaches about 65% to about 95% of the saturated amount of bonded oxygen of the fiber, wherein tension is applied such that the shrinkage of the fiber during oxidation reaches about 70% to about 90% of the degree of free shrinkage at the same temperature, and then activating the fiber. The activation is by heating the oxidized fiber in gas selected from $CO_2$, $NH_3$, steam or mixture thereof at a temperature of about 700° C. to about 1,000° C. for 10 minutes to 3 hours while the fiber is allowed to shrink freely, to thereby provide a specific surface area to said carbon fiber of from 300 $m^2/g$ to 2,000 $m^2/g$ (In the present application specific surface is determined by B.E.T. method using nitrogen gas adsorption isotherm at 25° C.). The activated carbon fiber of the present invention obtained in this manner contains about 80 to about 90 wt% carbon, about 3 to about 15 wt% nitrogen, about 2 to about 10 wt% oxygen and less than about 1 wt% hydrogen. The activated carbon fiber has a specific surface area of about 300 to about 2,000 $m^2/g$, a tensile strength of about 20 to about 80 $Kg/mm^2$, a tensile strength elongation of about 0.5 to 3% and a tensile modulus of about 1,500 to about 5,000 $Kg/mm^2$.

BRIEF DESCRIPTION OF THE ACCOMPANYING DRAWINGS

DETAILED DESCRIPTION OF THE INVENTION

Figure 3:
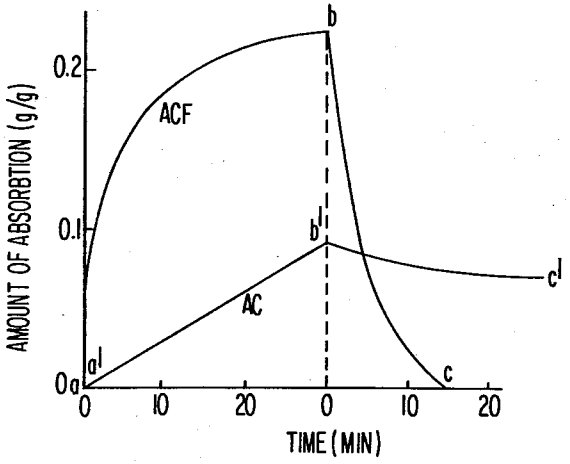
FIG. 3 illustrates the adsorption-desorption characteristics of the activated carbon fiber according to the method of the present invention.

Acrylonitrile based polymers which are used as starting materials for the acrylonitrile based fiber of the present invention, are acrylonitrile homopolymers and acrylonitrile copolymers. Examples of these copolymers are those containing not less than about 60% by weight, preferably not less than 85% by weight, acrylonitrile.

In the present invention, mixtures of homopolymers and copolymers or mixtures of copolymers themselves can be used to produce the fiber. Moreover, copolymers containing less than about 60% by weight acrylonitrile can be used in admixture with acrylonitrile polymers to produce the fiber, if the amount of acrylonitrile in the ultimate fiber exceeds about 60% by weight.

When a mixture of polymers is used, if some of these polymers contain only a small amount of acrylonitrile, phase-separation of the spinning solution or splitting of the fiber after spinning will sometimes occur. Since the use of mixtures of polymers does not result in any special effects and, on the contrary, since the possibility of occurrence of the above-described problems exists, such mixtures are rarely used. In using these mixtures, however, care must be taken with respect to combinations of comonomers, polymers, and the like, proportions thereof, spinning methods to be used, etc.

Comonomers which can be introduced into the above copolymers include addition-polymerizable vinyl compounds such as vinyl chloride, vinylidene chloride, vinyl bromide, acrylic acid, methacrylic acid, itaconic acid; the salts (e.g., the sodium salts) of these acids; derivatives of these acids, e.g., acrylic acid esters (e.g., alkyl esters containing 1 to 4 carbon atoms in the alkyl moiety such as methyl acrylate, butyl acrylate, and the like), methacrylic acid esters (e.g., alkyl esters containing 1 to 4 carbon atoms in the alkyl moiety such as methyl methacrylate, and the like); acrylamide, N-methylolacrylamide; allyl sulfonic acid, methallyl sulfonic acid, vinyl sulfonic acid, and the salts (e.g., the sodium salts) of these acids; vinyl acetate; 2-hydroxyethylacrylate; 2-hydroxyethylmethacrylate; 2-hydroxyethylacrylonitrile; 2-chloroethylacrylate; 2-hydroxy-3-chloropropylacrylate; vinylidene cyanide; α-chloroacrylonitrile; and the like. In addition, those compounds described in U.S. Pat. No. 3,202,640 can be used.

The degree of polymerization of these polymers or polymer mixtures will be sufficient if a fiber can be formed, and it is generally about 500 to about 3,000, preferably 1,000 to 2,000.

These acrylonitrile based polymers can be produced using hitherto known methods, for example, suspension polymerization or emulsion polymerization in an aqueous system, or solution polymerization in a solvent. These methods are described in, for example, U.S. Pat. Nos. 3,208,962, 3,287,307 and 3,479,312.

Spinning of the acrylonitrile based polymer can be carried out by hitherto known methods. Examples of spinning solvents which can be used include inorganic solvents such as a concentrated solution of zinc chloride in water, concentrated nitric acid and the like, and organic solvents such as dimethylformamide, dimethylacetamide, dimethyl sulfoxide, and the like. Examples of spinning methods which can be used are dry spinning and wet spinning. In wet spinning, in general, steps such as coagulation, waterwashing, stretching, shrinking, drying and the like are suitably combined. These spinning methods are described in U.S. Pat. Nos. 3,135,812 and 3,097,053.

This stretching is carried out to the same extent as in a usual acrylonitrile based fiber, and a suitable degree of stretching is generally about 5 to about 30 times the original length.

The strength of the activated carbon fiber produced in this invention is almost proportional to that of the acrylonitrile based fiber as the starting material.

In the present invention, when an organic solvent is used in spinning, the residual solvent in the fiber tends to cause the fiber to deteriorate at the oxidation processing thereof. Care must be, therefore, taken to remove or at least decrease the residual solvent content. For these reasons, it is desirable to use an inorganic solvent as a solvent. In particular, when a concentrated solution of zinc chloride in water is used, the residual zinc chloride in the fiber reduces the activation period, and moreover, a fiber having high strength can be obtained.

The diameter of the fiber which can be used in the present invention can be varied, but a suitable diameter is generally about 5 to about 30μ, preferably 10 to 20μ, from the standpoint of processing.

Although the oxidation processing in an oxidizing atmosphere is generally carried out in air, any mixture of oxygen and inert gases such as nitrogen can be used provided that they contain oxygen in an amount not less than about 15 vol%. In addition, the processing can be carried out in an atmosphere of hydrogen chloride gas, sulfur dioxide, NO or $NH_3$. In these cases, however, mixtures of these gases and air (with a gas mixture oxygen content of about 5 to about 20 vol%) are generally used.

A suitable oxidation temperature is about 200° C. to about 300° C., preferably 200° C. to 280° C. When the temperature is below about 200° C., a long period of time is needed for the oxidation, whereas the temperature is above about 300° C., the fiber will burn or the oxidation will proceed rapidly, thereby making it difficult to achieve uniform oxidation. The temperature can be changed during the oxidation processing. In general, since the rate of oxidation gradually decreases as the reaction proceeds, it is desired to gradually increase the temperature within the range of about 200° C. to about 300° C.

Preferably, tension is applied in such a manner that the shrinkage at a specific oxidation temperature reaches about 70% to about 90% of the degree of free shrinkage at that temperature. In this case, when the shrinkage is below about 70%, the adsorption property of the filament is insufficient for practical use, whereas when the shrinkage is above about 90%, the mechanical properties of the fiber obtained after the activation processing are reduced.

The term "degree of free shrinkage" as used in the description herein of the present invention designates the ratio of the shrinkage to the original length, that is, when the fiber under a tension of 1 mg/d is allowed to shrink in an oxidizing atmosphere at a specific temperature with oxidation proceeding, the ratio of the shrinkage to the original length is designated as the degree of free shrinkage at the temperature.

Figure 1:
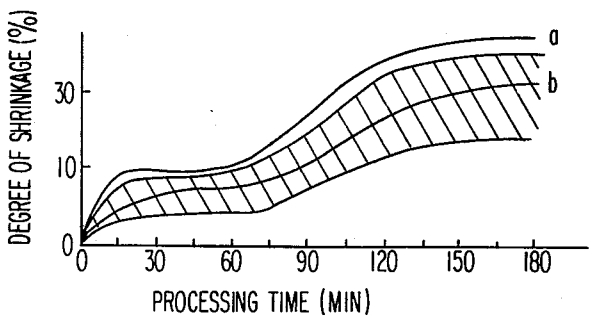
FIG. 1 illustrates the relationship between the degree of free shrinkage and the processing time of an acrylonitrile based fiber at the step of oxidation.

Referring to FIG. 1, the free shrinkage as used in the present invention will be explained. The fiber as herein used is the same as used in Example 1. Curve a schematically illustrates the change in the degree of free shrinkage with the lapse of time where the fiber is subjected to oxidation processing in air heated to 250° C. The free shrinkage behavior of the acrylonitrile based fiber at the step of oxidation processing shows almost the same tendency even though the temperature changes. The oblique area indicates the scope of shrinkage in the present invention.

The adjustment of the tension can be attained by using a plurality of independent speed-variable rollers and by controlling the speed of each roller in such a manner that the running speed of the fiber is changed, and thus it is possible to apply a constant tension on the fiber as the oxidation proceeds. As the number of rollers is increased, it is possible to more correctly adjust the shrinkage at each oxidation step. In general, five or more, preferably ten or more rollers are used.

Curve b shows the case when the shrinkage at each step is substantially 70% of the free shrinkage.

At this step, the oxygen is bonded as the oxidation proceeds, but the amount of bonded oxygen exerts a significant influence on the adsorption capacity of the activated carbon fiber.

In the production of carbon fiber, change the oxidation reaction to carbonization of the fiber before the amount of bonded oxygen increases very much, is effective in obtaining a high quality carbon fiber having excellent mechanical properties. However, to obtain an activated carbon fiber having high adsorption capacities, i.e., an excellent amount of adsorption and rate of adsorption, preferably oxygen is sufficiently bonded at the step of oxidation processing, that is, the oxidation processing is carried out until the amount of bonded oxygen reaches about 65% to about 95% of the saturated amount of bonded oxygen of the fiber. The preferred amount of bonded oxygen is about 70 to about 90%. On the contrary, in the case of carbon fiber, it is as low as about 40%.

The term "saturated amount of bonded oxygen" is defined as follows: the fiber is oxidized in an oxidizing atmosphere with periodic sampling, and when the change in amount of bonded oxygen of the fiber stops, the amount of the bonded oxygen is determined and designated as the saturated amount of bonded oxygen. This saturated amount of bonded oxygen is determined completely by the polymer composition of the fiber.

Figure 2:
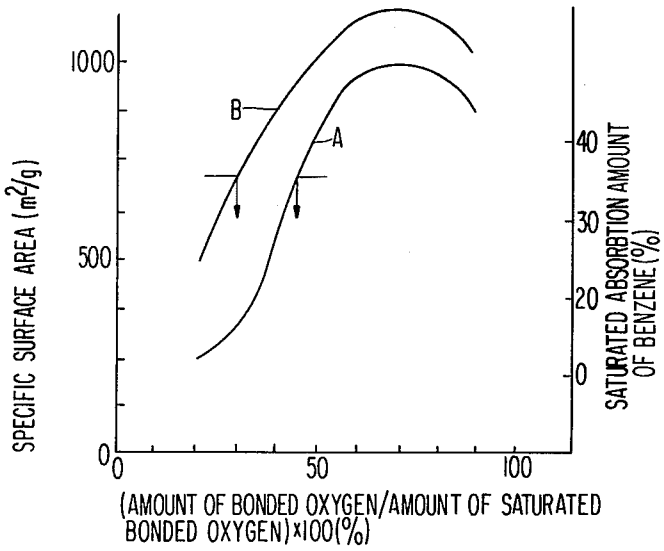
FIG. 2 illustrates the relationship between the amount of bonded oxygen and the specific surface area, and between the amount of bonded oxygen and the saturated adsorption amount of benzene of the fiber subjected to oxidation processing.

FIG. 2 shows the relationship between the amount of bonded oxygen at the stop of oxidation and the adsorption capacities of the activated carbon fiber. FIG. 2 shows the relationships between the amount of bonded oxygen and the saturated adsorption amount of benzene, and between the amount of bonded oxygen and the specific surface area of an activated carbon fiber, which is prepared by oxidizing an acrylonitrile based polymer fiber comprising 98 wt% of acrylonitrile and 2 wt% of methyl acrylate while varying the amount of oxygen to be bonded, and then activating the fiber in a steam at 800° C. Curves A and B show the former relationship and the latter relationship, respectively.

In this way, the amount of bonded oxygen at the step of oxidation processing directly influence the adsorption capacities of the activated carbon fiber, and at between about 65% and about 95% of the saturated amount of bonded oxygen, an extremely high adsorption capacity, is obtained.

The heat treating period in the oxidation processing is determined depending on the processing temperature, and it is generally about 0.5 hour to about 24 hours.

The oxidation processing of the fiber is followed by activation processing.

This activation processing can be accomplished by physical activation or a method comprising impregnating the fiber with an activating agent used in chemical activation and then applying physical activation. These methods are described in U.S. Pat. Nos. 2,790,781 and 2,648,637, for example.

For instance, where the activation is carried out in an activation gas, $CO_2$, $NH_3$, steam or a mixed gas thereof (e.g., $CO_2+H_2O$) is used (in this case, the allowable amount of oxygen can be an extent that the fiber does not burn, and the amount of oxygen is generally not more than 3 vol%). One or more inert gases such as $N_2$, Ar or Me may be contained in an activation gas in an amount of 0 to about 50 vol% (e.g., $CO_2+N_2$, etc.). The activation is generally carried out at a temperature of about 700° C. to about 1,000° C. for about 1 minute to about 3 hours.

When the physical activation is applied after impregnation of chemicals, activation chemicals which have hitherto been used in producing activated carbon can be used as these chemicals. For instance, the oxidized fiber is dipped in an aqueous solution of zinc chloride, phosphoric acid, sulfuric acid, sodium hydroxide, hydrochloric acid, or the like (in the case of hydrochloric acid, generally about 10 wt% to about 37 wt%, and in the case of other chemicals, generally about 10 wt% to about 60 wt%). Alternatively, solutions of these materials are sprayed on the fiber to deposit them thereon. Thereafter, the fiber is activated in an activation gas, in general, at about 700° C. to about 1,000° C. for about 1 minute to about 3 hours. In this case, the amount of the chemical (solute) deposited is about 0.1 wt% to about 20 wt% based on the fiber. Of course, it is possible to deposit an amount of more than 20 wt%, but no special effect due to such a large amount is obtained.

In this activation processing, the fiber is allowed to shrink freely. The shrinkage is generally about 10% to about 30% based on the fiber oxidized.

By this activation, the volatile component of the fiber is removed, and the fiber is carbonized, and at the same time, the specific surface area of the fiber is increased. It is possible to increase the specific surface area to about 300 $m^2/g$ to about 2,000 $m^2/g$. The carbon content of the fiber is about 80 wt% to about 90 wt%. The diameter of the fiber obtained is generally about 3$\mu$ to about 15$\mu$.

In the present invention, products in the form of a woven fabric, nonwoven fabric, felt, or the like can be first produced as described from the fiber subjected to the oxidation processing, and they are then activated in the same manner as the fiber. For instance, when the activation is applied after the fiber is converted into the form of a felt, a shrinkage of about 20% based on the original before the activation occurs.

The activated carbon fiber produced by the method of the present invention has a quite excellent rate of adsorption, amount of adsorption, and rate of desorption as compared with activated carbon as shown in FIG. 3. In FIG. 3, Curves a–b and a′–b′ show the changes with time in the amount of adsorption of toluene per gram of activated carbon fiber (ACF) and activated carbon (AC), respectively, when air containing 750 ppm of toluene is passed at a temperature of 25° C. and an air velocity of 2.5 cm/sec. On the other hand, Curves b–c and b′–c′ show the changes with time in the amount of desorption of toluene of activated carbon fiber and activated carbon at 100° C., respectively. The fiber as herein used is the same as produced in Example 2. As the activated carbon, SHIRASAGI (trade name, granular activated carbon produced by Takeda Chemical Industries, Ltd., specific surface area: about 1,000 $m^2/g$) was used.

With the activated carbon fiber of the present invention, as shown in FIG. 3, the rate of adsorption is approximately 50 times faster than activated carbon, and with regard to desorption, desorption can be carried out by heating or a like method more completely and approximately 50 times faster than activated carbon. Also, one of the advantages of the present invention is that it is possible to remove the material to be adsorbed from an environment for a certain period, that is, until the saturated amount of adsorption is reached and the concentration of the material in the environment reaches zero.

Moreover, since the activated carbon fiber produced from this acrylic fiber contains 3 wt% to 15 wt% of nitrogen (as elemental nitrogen) among the elements thereof, it exhibits high affinity to, in particular, mercaptans, and it shows a saturated adsorption amount approximately 20 times higher than conventional activated carbon. With other materials to be adsorbed, such as acetone, benzene, trimethylamine, ammonia, methyl sulfide, hydrogen sulfide, nitrogen dioxide, sulfur dioxide, and the like, it is possible to attain adsorption which is two or more times higher.

Due to the sufficient mechanical strength of the activated carbon fiber of the present invention, it is possible to fabricate the fiber into various forms such as a fabric, a felt, and the like. Thus, it is easy to handle. In addition, when air containing a solvent as described above passes, a uniform flow is attained, and no short pass occurs as in the case of activated carbon. Because the rate of adsorption is fast and the volume of adsorption is large, as described above, it is possible to remove gases with a layer having a thickness which is thinner than that for conventional activated carbon, as a result of which it is possible to produce an apparatus whose pressure drop is small.

As is apparent from the above detailed description, the activated carbon fiber produced by the method of the present invention has excellent characteristics.

Hereinafter, the present invention will be explained in more detail by reference to the following examples. Unless otherwise indicated, all percents, parts, ratios and the like are by weight and the adsorption amount indicates the saturated adsorption amount. Chemical constituents, specific surface area, properties of activated carbon fibers obtained in Examples 1–9 and Comparative Examples 1–2 were measured and obtained results are shown in Table 1. Specific surface area was measured by B.E.T. method.

EXAMPLE 1

To a solution comprising 90 parts of a 60% by weight solution of zinc chloride in water, 9.7 parts of acrylonitrile, and 0.3 part of methyl acrylate was added 0.1 part of sodium persulfate as a catalyst, which was polymerized at 50° C. for about 3 hours in a homogeneous solution system. The resulting polymer solution (molecular weight of the polymer: about 85,000) was spun through a 30% by weight solution of zinc chloride in water at 15° C. using a nozzle having a pore diameter of 0.08 mm $\phi$ with the number of holes in the nozzle being 1,000, washed with water while stretching the filament about two times the original length, dried in a dryer at 120° C. for about 1 minute, and stretched 5 times the original length in steam at 130° C., and thus a fiber of 1.5 denier was obtained.

The thus obtained fiber was processed in air at 250° C. in an electric oven for about 6 hours while applying a tension to provide 75% shrinkage based on the free shrinkage until the amount of bonded oxygen reached 75% of the saturated amount of bonded oxygen. Then, activation processing was conducted for 30 minutes while supplying steam at 800° C. at a rate of 0.5 g/min. per gram of the fiber.

The thus obtained activated carbon fiber had a diameter of 5$\mu$ and a tensile strength of 30.90 Kg/mm$^2$. (In the present invention mechanical properties were measured in accordance with JIS L 1069 except for drawing the fiber tested at a rate of 1 mm/min. instead of 20 mm/min., hereinafter the same.) This activated carbon fiber had sufficient mechanical strength. Also, the specific surface area was 1,050 m$^2$/g, the benzene adsorption amount was 47% based on the weight of the fiber, and the butylmercaptan adsorption amount was 2,400% by weight. That is, it had an adsorption capacity of 1.5 times and 27 times a commercially available granular activated carbon. In this way, an activated carbon fiber having excellent adsorption capacities was obtained.

COMPARATIVE EXAMPLE 1

The same experimentation as in Example 1 except that the oxidation reaction was conducted without application of tension, was repeated. Only a weak fiber of a tensile strength of 8.3 Kg/mm$^2$ was obtained.

COMPARATIVE EXAMPLE 2

The acrylonitrile fiber obtained in Example 1 was processed in air at 220° C. in an electric oven for about 10 hours while applying a tension to provide 70% shrinkage based on the free shrinkage until the amount of bonded oxygen reached 40% of the saturated amount of bonded oxygen.

Then, the same activation processing as used in Example 1 was applied, but the specific surface area of the activated carbon fiber was as low as 750 m$^2$/g. In this way, a fiber having excellent adsorption capacities was not obtained.

EXAMPLE 2

The acrylonitrile fiber used in Example 1 was oxidized in air at 260° C. for about 4 hours while applying such a tension to provide 75% shrinkage until the amount of bonded oxygen reached 80% of the saturated amount of bonded oxygen.

This fiber was fabricated into a felt (400 g/m$^2$) having a width of 200 mm using a needle punch. The thus obtained felt was introduced into a veritical type tube (effective heating area: 1.5 m) through an inlet provided with a sealing mechanism at the top thereof. The above felt was continuously conveyed at 1.5 m/hr in an atmosphere at a temperature of 800° C. in which steam was fed at a rate of 200 m$^3$/hr, and the activated carbon fiber in the form of a felt was withdrawn from the bottom of the tube through a liquid sealing mechanism to the outside of the system.

With the thus obtained activated carbon fiber in the form of a felt, the specific surface area according to the B.E.T. method was 950 m$^2$/g, and the benzene adsorption amount was 49% by weight. With regard to the rate of adsorption of butylmercaptan, the above activated carbon fiber was 50 times faster than a commercially available granular activated carbon, and furthermore, the saturated adsorption amount was 2,420%. The saturated adsorption amount of granular activated carbon used for a comparison was 90%, and it can be understood that the adsorption capacity of the activated carbon fiber was approximately 27 times larger than the activated carbon.

EXAMPLE 3

An acrylonitrile based fiber comprising 90 wt% of acrylonitrile, 9 wt% of vinylidene chloride, and 1 wt% of sodium allylsulfonate (molecular weight: 70,000 to 80,000; tensile strength: approximately 5 g/denier; a fiber having the same molecular weight and tensile strength as this fiber was used in the subsequent examples) was processed for about 5 hours in air at 260° C. while applying such a tension to provide 75% shrinkage until the amount of bonded oxygen reached 80% of the saturated amount of bonded oxygen.

Then the fiber oxidized was fabricated into the form of a fabric (400 g/m$^2$) and was subjected to activation processing for 30 minutes while supplying steam at 800° C. at a rate of 0.5 g/min. per gram of the fabric. Thus, an activated carbon fabric was obtained.

With the thus obtained activated carbon fabric, the specific surface area was 1,000 m$^2$/g, the benzene adsorption amount was 41 wt%, and the butylmercaptan adsorption amount was 1,900 wt%.

EXAMPLE 4

An acrylonitrile based fiber comprising 92 wt% of acrylonitrile, 7 wt% of vinyl bromide, and 1 wt% of sodium methallylsulfonate was processed in an atmosphere of sulfur dioxide (mixture with air, $O_2$ content: 5 vol%) gas at 250° C. for about 7 hours while applying such a tension to provide 75% shrinkage based on the degree of free shrinkage until the amount of bonded oxygen reached 85% of the saturated amount of bonded oxygen. Then a nonwoven fabric (350 g/m$^2$) was produced from this fiber.

The thus obtained nonwoven fabric was subjected to activation processing at 850° C. for 30 minutes while supplying steam in a rate of 1 g/min. per gram of the nonwoven fabric.

The thus obtained nonwoven fabric comprising activated carbon fiber had a tensile strength of 80 g/cm (width), and it had sufficient strength for handling. The specific surface area was 1,300 m$^2$/g, the benzene adsorption amount was 51 wt%, and the butylmercaptan adsorption amount was 2,400 wt%. Thus, the activated carbon fiber had a larger adsorption capacity than conventional activated carbon and had excellent adsorption capacities.

EXAMPLE 5

A fiber of 1.5 denier comprising 92 wt% of acrylonitrile, 4 wt% of methyl acrylate, and 4 wt% of itaconic acid was subjected to heating processing in the same manner as in Example 1, and an oxidized fiber was thus obtained. This fiber was subjected to the same activation processing as in Example 1. With regard to the thus obtained activated carbon fiber, the diameter was 5$\mu$, the tensile strength was 39.4 Kg/mm$^2$, which was sufficient mechanical strength, the specific surface area was 1,150 m$^2$/g, the benzene adsorption amount was 50 wt%, and the butylmercaptan adsorption amount was 2,400 wt%.

These data indicate that the adsorption capacity of the activated carbon fiber was far larger than that of activated carbon, and that the activated carbon fiber had excellent adsorption capacities.

EXAMPLE 6

On the oxidized fiber obtained in Example 1 was deposited phosphoric acid (10% aqueous solution) in an amount (solids basis) of 2 wt% based on the weight of the fiber. Then the thus prepared fiber was subjected to activation processing for 25 minutes while supplying steam at 800° C. at a rate of 0.5 g/min. per gram of fiber.

With regard to the thus obtained activated carbon fiber, the diameter was about 5$\mu$, the tensile strength was 32.5 Kg/mm$^2$, which was sufficient mechanical strength, the specific surface area was 1,050 m$^2$/g, the benzene adsorption amount was 47 wt%, and the butylmercaptan adsorption amount was 2,350 wt%.

These data indicate that the adsorption capacity of the activated carbon fiber was 1.5 times and 26 times, respectively, that of commercially available activated carbon, and that it had excellent adsorption capacity.

EXAMPLE 7

The oxidized fiber obtained in Example 1 was cut to 51 mm to produce a short fiber, which was needle-punched to produce a felt (380 g/m$^2$). On this felt was deposited zinc chloride (10% aqueous solution) in an amount of 5 wt% (solids basis), which was then subjected to activation processing for 23 minutes while supplying steam at 800° C. at a rate of 0.5 g/min. per gram of the felt. The activated felt had a tensile strength of 120 g/cm (width), which was sufficient strength for handling.

With this felt, the specific surface area was 1,100 m$^2$/g, the benzene adsorption amount was 48 wt%, and the butylmercaptan adsorption amount was 2,350 wt%. These data indicate that the adsorption capacity of the felt was quite excellent as compared with commercially available activated carbon.

EXAMPLE 8

The oxidized fiber obtained in Example 1 was subjected to activation processing at 800° C. in an atmosphere of carbon dioxide gas for 30 minutes.

With the thus obtained activated carbon fiber, the diameter was 6$\mu$, the tensile strength was 39.0 Kg/mm$^2$ which was sufficient mechanical strength, the specific surface area was 920 m$^2$/g, and the butylmercaptan adsorption amount was 2,260 wt%. Thus, an activated carbon fiber was obtained which had superior adsorption capacity to that of commercially available granular activated carbon.

EXAMPLE 9

An acrylonitrile based fiber comprising 90 wt% of acrylonitrile, 7 wt% of acrylic acid and 1 wt% of sodium methallysulfonate (3 denier$\times$30,000 monofilaments) was processed in air at 250° C. for 6 hours while applying such a tension to provide 80% shrinkage based on the degree of free shrinkage until the amount of bonded oxygen reached 60% of the saturated amount of bonded oxygen. Then the thus oxidized fibers were subjected to activation processing in steam at 850° C. for 15 minutes.

| Example No. | | 1 | Comparative Example 1 | Comparative Example 2 | 2 | 3 | 4 | 5 | 6 | 7 | 8 | 9 |
|---|---|---|---|---|---|---|---|---|---|---|---|---|
| Constituent (wt %) | C | 88.2 | | | 87.8 | 84 | 83 | 87.7 | 87.7 | 87.8 | 87.1 | 84.5 |
| | N | 4 | | | 4.1 | 4.9 | 3.9 | 3.7 | 4.0 | 4.1 | 5.0 | 4.5 |
| | O | 7 | | | 7.1 | 9.7 | 11.9 | 7.8 | 7.4 | 7.2 | 7.0 | 10 |
| | H | 0.8 | | | 1.0 | 0.9 | 1.0 | 0.8 | 0.9 | 0.9 | 0.9 | 1 |
| Specific Sur- | | | | | | | | | | | | |

-continued

| Example No. | 1 | Comparative Example 1 | Comparative Example 2 | 2 | 3 | 4 | 5 | 6 | 7 | 8 | 9 |
|---|---|---|---|---|---|---|---|---|---|---|---|
| face Area ($m^2/g$) | 1050 | | 750 | 950 | 1000 | 1300 | 1150 | 1050 | 1100 | 920 | 1200 |
| Fiber Properties | | | | | | | | | | | |
| (tensile) | | | | | | | | | | | |
| Strength ($Kg/mm^2$) | 30.90 | 8.3 | 24.4 | 29.70 | 30.2 | 30.0 | 39.4 | 32.5 | 30.8 | 39.0 | 34.0 |
| Elongation (%) | 1 | 0.4 | 1.1 | 1.1 | 0.9 | 1.0 | 1.3 | 1.1 | 1.0 | 1.3 | 0.9 |
| Modulus ($Kg/mm^2$) | 3090 | 2080 | 2220 | 2700 | 3360 | 3000 | 3030 | 2960 | 3080 | 3000 | 3780 |
| Felt or Fabric | | | | | | | | | | | |
| Properties | | | | | | | | | | | |
| (tensile) | | | | | | | | | | | |
| Strength (g/cm) | | | | 93 | 2360 | 91 | | | 95 | | |
| Elongation (%) | | | | 100 | | 104 | | | 102 | | |
| Weight of Fabric or Felt per $1m^2$ ($g/m^2$) | | | | 80 | 100 | 75 | | | 78 | | |
| Absorption Capacity (%) | | | | | | | | | | | |
| Sulfur | 0.5 | | | 0.48 | 0.50 | 0.45 | 0.43 | 0.51 | 0.51 | 0.52 | 0.50 |
| Dioxide | (7.1) | | | (7) | (7.1) | (5.5) | (6.1) | (7.3) | (7.3) | (7.4) | (7.1) |
| Nitrogen | 0.2 | | | 0.17 | 0.20 | 0.16 | 0.15 | 0.20 | 0.2 | 0.22 | 0.18 |
| Dioxide | (20) | | | (17) | (19) | (16) | (15) | (20) | (20) | (22) | (18) |
| Hydrogen | 0.3 | | | 0.34 | 0.49 | 0.30 | 0.27 | 0.32 | 0.3 | 0.48 | 0.30 |
| Sulfide | (50) | | | (56) | (81) | (50) | (45) | (50) | (50) | (80) | (50) |
| Butyl | 2400 | | 30 | 2420 | 1900 | 2400 | 2400 | 2350 | 2350 | 2260 | 2290 |
| Mercaptane | (27) | | | (27) | | | | | | | |
| Benzene | 47 | | | | | | | | | | |
| | (1.5) | | 5 | 42 | 41 | 51 | 50 | 47 | 48 | 40 | 50 |
| | | | | | | | | (1.5) | | | |

*Values shown in parenthesis was calculated as activated carbon (Shrasagi: used hereinbefore) is 1. Adsorption capacity of activated carbon fiber was measured under condition shown in Table 2.

TABLE 2

| Gas Absorbed | Concentration of Gas (ppm) | Velocity of Gas (cm/sec) | Height of Layer of Absorbent | Absorption Temperature (°C.) |
|---|---|---|---|---|
| Sulfur Dioxide | 10 | 10 | 10 | 23 |
| Nitrogen Dioxide | 12 | " | " | " |
| Hydrogen Sulfide | 4 | " | " | " |

Adsorption of benzene was measured according to JIS K 1474-1975. Adsorption of butylmercaptane was measured by placing a definite amount of activated carbon fibers in the space of a desiccator containing butylmercaptane and determine the saturated amount of adsorbed butylmercaptane at 25° C. by measuring the increased weight of the activated carbon fibers.

EXAMPLE 10

This experiment was conducted to show that it is necessary to apply tension to the fibers in such a manner that the shrinkage during oxidation to obtain activated carbon fibers having high tensile strength does not exceed 90% of free shrinkage.

The procedure of Example 1 was repeated except that the acrylonitrile and methacrylate in the polyacrylonitrile fibers were changed to 97 and 3 wt %, respectively, the amount of bonded oxygen was 60% of the saturated amount of bonded oxygen and the applied tension during oxidation was such that 70% shrinkage [based on the free shrinkage] was provided to the fibers.

As a comparison, the procedure thus described was duplicated except that 95% shrinkage, [based on the free shrinkage] was provided to the fibers during oxidation.

Figure 4:
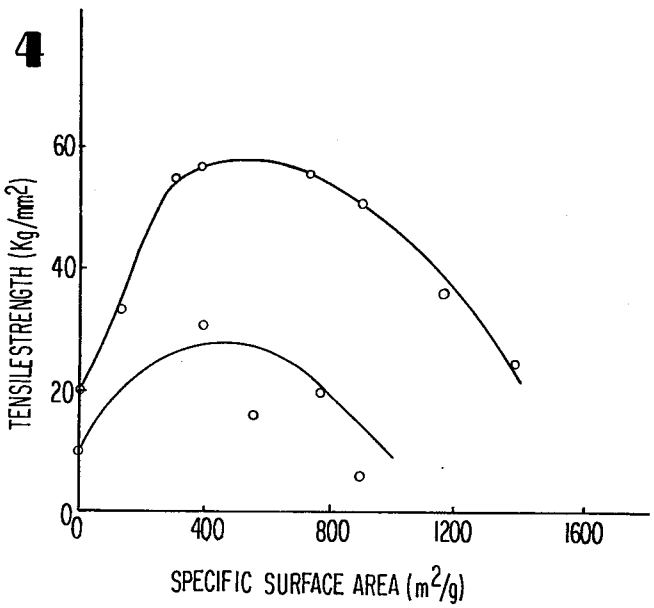
FIG. 4 illustrates the relationship between the tensile strength and the surface area values of activated carbon fibers.

The tensile strength and the surface area values obtained are shown in FIG. 4 with the 70% shrinkage run represented by the circled points and the 95% shrinkage run represented by solid points.

It can be seen from the results that when the shrinkage exceeds 90%, the tensile strength of the activated carbon fibers becomes low and activated carbon having high specific area cannot be obtained in the form of a fiber.

While the invention has been described in detail and with reference to specific embodiments thereof, it will be apparent to one skilled in the art that various changes and modifications can be made therein without departing from the spirit and scope thereof.

What is claimed is:

1. A process for producing activated carbon fibers of high adsorption capacity which contain about 80 to about 90 weight percent carbon, about 3 to about 15 weight percent nitrogen, about 2 to about 10 weight percent oxygen and less than 1 weight percent hydrogen, which comprises oxidizing an acrylonitrile based polymer which is a homopolymer of acrylonitrile, a copolymer containing about 60% by weight or more acrylonitrile, or a mixture of polymers such that about 60% by weight or more of acrylonitrile is present in the mixture, in an oxidizing atmosphere at a temperature of about 200° C. to about 300° C. while applying a tension to the fiber until the amount of bonded oxygen reaches about 65% to about 95% of the saturated amount of bonded oxygen of the fiber, wherein the tension applied is such that the shrinkage of the fiber during oxidation reaches about 70% to about 90% of the degree of free shrinkage at the same temperature, and then activating the fiber, wherein activation is by heating the oxidized fiber in a gas selected from $CO_2$, $NH_3$, steam or a mixture thereof at a temperature of about 700° C. to about 1,000° C. for 1 minute to 3 hours while the fiber is allowed to shrink freely, to thereby provide a specific surface area to said carbon fiber of from 300 $m^2/g$ to 2,000 $m^2/g$, a tensile strength of about 20 to about 80 $Kg/mm^2$, a tensile elongation of about 0.5 to 3% and a tensile modulus of about 1,500 to about 5,000 $Kg/mm^2$.

2. The process according to claim 1, wherein the copolymer comprises acrylonitrile and at least one monomer copolymerizable therewith selected from the group consisting of vinyl chloride, vinylidene chloride, vinyl bromide, acrylic acid, methacrylic acid, itaconic acid, the salts of these acids, the alkyl esters of these acids in which the alkyl moiety has 1 to 4 carbon atoms, acrylamide, N-methylolacrylamide, allyl sulfonic acid, methallyl sulfonic acid, vinyl sulfonic acid, the salts of these acids, vinyl acetate, 2-hydroxyethylacrylate, 2-hydroxyethylmethacrylate, 2-hydroxyethylacrylonitrile, 2-chloroethylacrylate, 2-hydroxy-3-chloropropylacrylate, vinylidene cyanide and α-chloroacrylonitrile.

3. The process according to claim 1, wherein the oxidizing is in an oxidizing atmosphere containing about 15 vol% or more of oxygen.

4. The process according to claim 1, wherein the oxidizing is in an atmosphere of hydrogen chloride, sulfur dioxide, NO or $NH_3$, each containing about 5 vol% to about 20 vol% of oxygen.

5. The process according to claim 1, wherein the activating is by heating the fiber in said activation gas after an aqueous solution of zinc chloride, phosphoric acid, sulfuric acid, hydrochloride acid, or sodium hydroxide has been deposited thereon.

6. The process according to claim 1, wherein the activating is after fabricating the oxidized fiber into the form of a woven fabric, a nonwoven fabric, or a felt.

7. The process according to claim 1, wherein said tension is attained by passing said fibers over a plurality of independent speed-variable rollers in such a manner that the running speed of the fiber is changed to apply constant tension to the fiber as the oxidation proceeds.

8. The process according to claim 1, wherein said activation gas is $CO_2$.

9. The process according to claim 1, wherein said activation gas is $NH_3$.

10. The process according to claim 1, wherein said activation gas is steam.

11. The process according to claim 1, wherein during activation the fiber is allowed to shrink freely.

12. The process according to claim 11, wherein the shrinkage is about 10% to about 30% based on the fiber oxidized.

13. The process according to claim 11, wherein the specific surface area of the fiber is increased during said activation.

14. The process according to claim 1, wherein said activating follows said oxidizing without an intermediate carbonization treatment.

15. An activated carbon fiber containing about 80 to about 90 wt% carbon, about 3 to about 15 wt% nitrogen, about 2 to about 10 wt% oxygen and less than about 1 wt% hydrogen, said activated carbon fiber having a specific surface area of about 300 to about 2,000 $m^2/g$, a tensile strength of about 20 to about 80 $Kg/mm^2$, a tensile elongation of about 0.5 to 3% and a tensile modulus of about 1,500 to about 5,000 $Kg/mm^2$.

16. The activated carbon fiber according to claim 15, wherein said fiber has a diameter of 3 to 15 microns.

17. The activated carbon fiber according to claim 15, produced by a process comprising oxidizing an acrylonitrile based fiber, which is a homopolymer of acrylonitrile a copolymer containing about 60% by weight or more of acrylonitrile, or a mixture of polymers such that about 60% by weight or more of acrylonitrile is present in the mixture, in an oxidizing atmosphere at a temperature of about 200° C. to about 300° C. while applying a tension to the fiber until the amount of bonded oxygen reaches about 65% to about 95% of the saturated amount of bonded oxygen of the fiber, wherein the tension applied is such that the shrinkage of the fiber during oxidation reaches about 70% to about 90% of the degree of free shrinkage, at the same temperature, and then activating the fiber, wherein activation is by heating the oxidized fiber in gas selected from $CO_2$, $NH_3$, steam or mixture thereof at a temperature of about 700° C. to about 1,000° C. for 1 minute to 3 hours while the fiber is allowed to shrink freely, to thereby provide a specific surface area to said carbon fiber of from 300 $m^2/g$ to 2,000 $m^2/g$.

18. The process according to claim 1, wherein the amount of bonded oxygen is about 70 to 90% of the saturated amount of bonded oxygen of the fiber.

19. The process according to claim 1, wherein the activation gas contains at least one inert gas in an amount of about 0 to 50 volume %.

* * * * *